US012122588B2

(12) United States Patent
Sanders et al.

(10) Patent No.: US 12,122,588 B2
(45) Date of Patent: Oct. 22, 2024

(54) HINGED BLADE DISPENSER

(71) Applicant: Stanley Black & Decker, Inc., New Britain, CT (US)

(72) Inventors: Cole Thomas Sanders, Higganum, CT (US); Gregory Tropea, Berlin, CT (US); Matthew Alan Seibert, Powell, OH (US)

(73) Assignee: Stanley Black & Decker, Inc., New Britain, CT (US)

( * ) Notice: Subject to any disclaimer, the term of this patent is extended or adjusted under 35 U.S.C. 154(b) by 176 days.

(21) Appl. No.: 17/859,524

(22) Filed: Jul. 7, 2022

(65) Prior Publication Data

US 2024/0010418 A1 Jan. 11, 2024

(51) Int. Cl.
*B65D 83/10* (2006.01)

(52) U.S. Cl.
CPC ..... *B65D 83/10* (2013.01)

(58) Field of Classification Search
CPC ..... B65D 83/10; B65D 85/1063; B26B 5/00
USPC ..... 221/84; 30/152, 124
See application file for complete search history.

(56) References Cited

U.S. PATENT DOCUMENTS 1,438,305 A * 12/1922 John ..... B65D 83/10 206/208
1,584,811 A * 5/1926 Schick ..... B26B 21/24 30/40
1,824,491 A * 9/1931 Walter ..... B65D 85/1063 206/256
1,842,727 A * 1/1932 Walter ..... B65D 5/5023 206/254
1,863,190 A * 6/1932 Coulapides ..... B65D 5/5495 206/256
1,875,197 A 8/1932 Everett
2,074,451 A 3/1937 Martin
2,357,208 A * 8/1944 Kuhnl ..... B65D 83/10 221/26
4,890,525 A * 1/1990 Bilbao ..... B26B 29/06 83/761
7,527,189 B2 5/2009 Billig et al.
7,677,390 B2 3/2010 Roesler
8,079,487 B2 12/2011 Roesler
8,985,327 B2 3/2015 Roesler
(Continued)

FOREIGN PATENT DOCUMENTS

CN 2628472 Y 7/2004
DE 1901173 A1 7/1969
(Continued)

OTHER PUBLICATIONS

Extended European Search Report, dated Oct. 19, 2023, in corresponding EP application No. 23182539.9-1002.

*Primary Examiner* — Rakesh Kumar
(74) *Attorney, Agent, or Firm* — Gabriel A. Haboubi

(57) ABSTRACT

According to an embodiment, a blade dispenser includes a body portion; and a lid portion slidable relative to the body portion to move the blade dispenser between a closed configuration and an extended configuration. The lid portion comprises a first lid portion having a first blade chamber and a second lid portion having a second blade chamber. The first lid portion and the second lid portion are coupled by a hinge portion configured to permit the first lid portion to pivot relative to the second lid portion to move the blade dispenser from the extended configuration to an open configuration. In the open configuration blades may be removed from or inserted into both the first blade chamber and the second blade chamber.

19 Claims, 8 Drawing Sheets

(56) References Cited

U.S. PATENT DOCUMENTS

| | | | | |
|---|---|---|---|---|
| D731,326 | S | 6/2015 | Johansson | |
| 10,457,463 | B2 | 10/2019 | Mayer et al. | |
| 11,220,370 | B2 * | 1/2022 | Purkey | B65D 1/36 |
| 11,358,292 | B2 * | 6/2022 | Garavaglia | B26B 5/001 |
| 2009/0288971 | A1 | 11/2009 | Webb et al. | |
| 2010/0037465 | A1 * | 2/2010 | Price | B26B 5/001 30/152 |
| 2011/0041344 | A1 | 2/2011 | De et al. | |
| 2012/0073142 | A1 * | 3/2012 | Zeng | B26B 5/001 30/162 |
| 2012/0097563 | A1 | 4/2012 | Packard et al. | |
| 2013/0061479 | A1 * | 3/2013 | Lutgen | B26B 5/003 30/329 |
| 2015/0083617 | A1 * | 3/2015 | Collins | B65D 85/1063 206/257 |

FOREIGN PATENT DOCUMENTS

| | | | | |
|---|---|---|---|---|
| DE | 7521716 | U | 11/1975 | |
| DE | 9403495 | U1 | 5/1994 | |
| DE | 20309569 | U1 | 8/2003 | |
| DE | 202009018095 | U1 | 1/2011 | |
| DE | 202012100258 | U1 | 2/2012 | |
| DE | 102012201087 | A1 | 7/2013 | |
| EP | 0627367 | A1 | 12/1994 | |
| EP | 0969952 | B1 | 3/2003 | |
| EP | 2153947 | A2 * | 2/2010 | B26B 5/001 |
| GB | 349034 | A * | 5/1931 | B65D 85/1063 |
| WO | 1999052690 | A1 | 10/1999 | |
| WO | 2004033321 | A2 | 4/2004 | |
| WO | WO-2014053529 | A1 * | 4/2014 | B65D 85/1063 |
| WO | 2021020508 | A1 | 2/2021 | |

* cited by examiner

HINGED BLADE DISPENSER

TECHNICAL FIELD

This application relates to blade dispensers for holding tool blades, such as utility knife blades.

BACKGROUND

Blade dispensers are configured to hold a plurality of blades for storage, or as product packaging for blades at point of sale. Such blades may be utility knife blades, but may also be other tool blades, such as hacksaw blades, reciprocating saw blades, jig saw blades, or other similar blades.

SUMMARY

According to an embodiment, a blade dispenser includes a body portion; and a lid portion slidable relative to the body portion to move the blade dispenser between a closed configuration and an extended configuration. The lid portion comprises a first lid portion having a first blade chamber and a second lid portion having a second blade chamber. The first lid portion and the second lid portion are coupled by a hinge portion configured to permit the first lid portion to pivot relative to the second lid portion to move the blade dispenser from the extended configuration to an open configuration. In the open configuration blades may be removed from or inserted into both the first blade chamber and the second blade chamber.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

Figure 1:
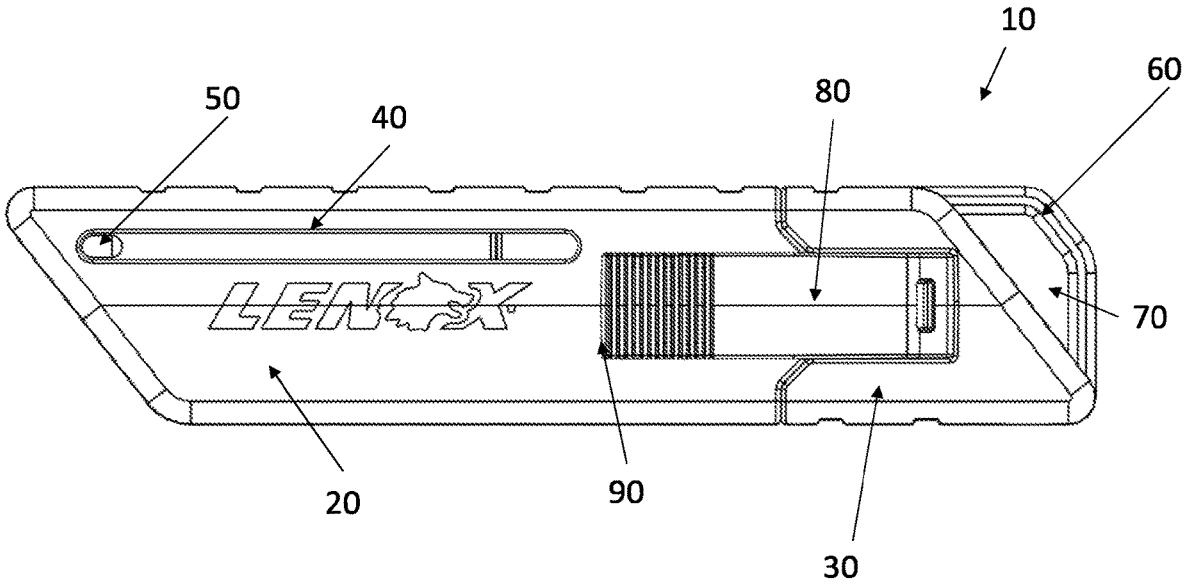
FIG. 1 is a rear view of an embodiment of a blade dispenser of the present disclosure in a closed position, having a body portion and a lid portion.

Referring to FIG. 1, a blade dispenser 10 may be configured to hold multiple blades therein. The blade dispenser 10 may include a body portion 20 and a lid portion 30. As shown, and described in greater detail below, in some embodiments the body portion 20 may include a slide track 40, along which a slide stop 50 may slide so as to guide a maximum desired movement between the lid portion 30 and the body portion 20 (e.g., with the slide stop 50 protruding into the slide track 40, such that when the slide stop 50 reaches an end of the slide track 40, further movement in that direction is prevented). As discussed in greater detail below, the slide stop 50 may be part of or fixed relative to the lid portion 30. In some embodiments, the orientations may be inverted, such that the slide track 40 is formed in the lid portion 30, while the slide stop 50 is formed in or fixed relative to the body portion 20. In an embodiment, the slide stop 50 may be spring biased, such as through a spring assembly or through a deformable but resilient construction or configuration. In some such embodiments, the slide stop 50 may be pressed against the spring bias to either remove the lid portion 30 from the body portion 20 when assembled (e.g., by pushing the slide stop 50 into the slide track 40 as shown), or may be pushed into the structure of the lid portion 30 when assembling the lid portion 30 into the body portion 20, such that once the slide stop 50 reaches the slide track 40, the slide stop 50 succumbs to the spring bias and protrudes into the slide track 40.

Further shown in FIG. 1 is a loop 60 defining an aperture 70. The loop 60 is illustrated as being formed on the lid portion 30, but in other embodiments may be formed on the body portion 20. In an embodiment, the loop 60 may support a lanyard or carabiner through the aperture 70. In some embodiments, the loop 60 may form part of a carabiner. Additionally shown in FIG. 1, although better appreciated in subsequent figures is a belt or pocket clip 80 which may be formed on the blade dispenser 10. In the illustrated embodiment, the clip 80 extends from the body portion 20, and may include a retaining feature 90 that may be used to additionally secure the lid portion 30 to the body portion 20 in some configurations, as described in greater detail below.

Figure 2:
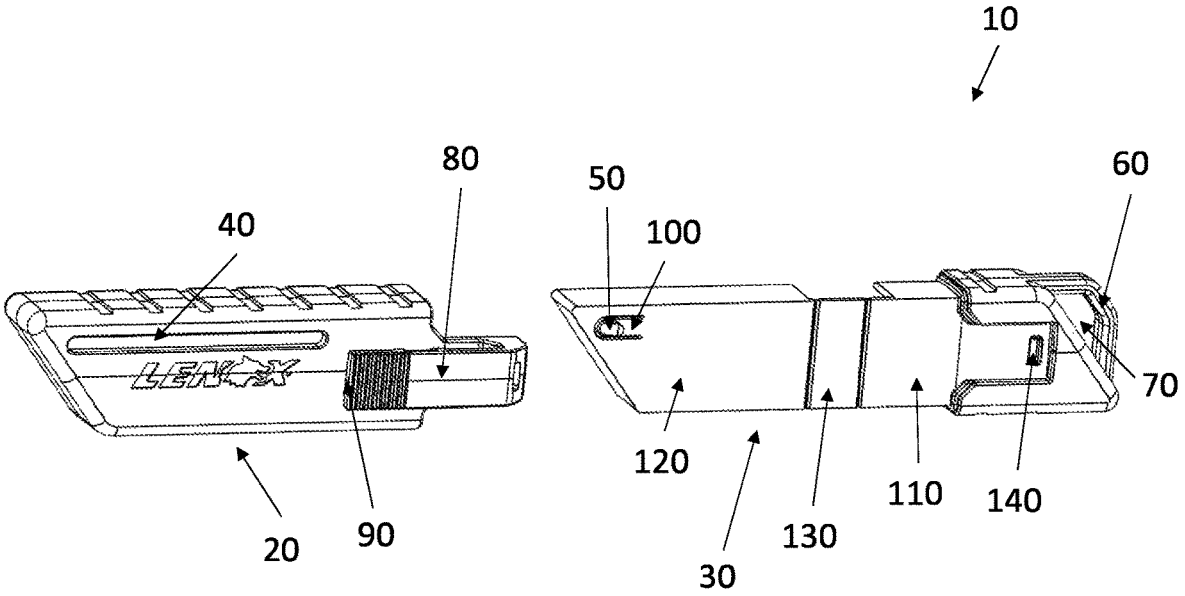
FIG. 2 is an exploded rear perspective view of the embodiment of the lid portion, with the lid portion removed from the body portion.

FIG. 2 shows the blade dispenser 10 in an exploded view, with the lid portion 30 extended from and removed from the body portion 20. As may be seen more clearly, in an embodiment the slide stop 50 may be formed on a spring arm 100 on the lid portion 30, allowing the slide stop 50 to deform into the lid portion 30 when desired, but returning protruding from the lid portion 30 so as to engage with the slide track 40 when the lid portion 30 is assembled into the body portion 20. As further shown, the lid portion 30 may include a first lid portion 110, a second lid portion 120, and a hinge portion 130 therebetween. In an embodiment the first lid portion 110, second lid portion 120, and hinge portion 130 may be integrally formed. As discussed herein, the hinge portion 130 may be configured to facilitate bending the first lid portion 110 relative to the second lid portion 120. Notably, in some embodiments the lid portion 130 includes an engagement feature 140, which may selectively engage with the retaining feature 90, as discussed in greater detail below.

Figure 3A:
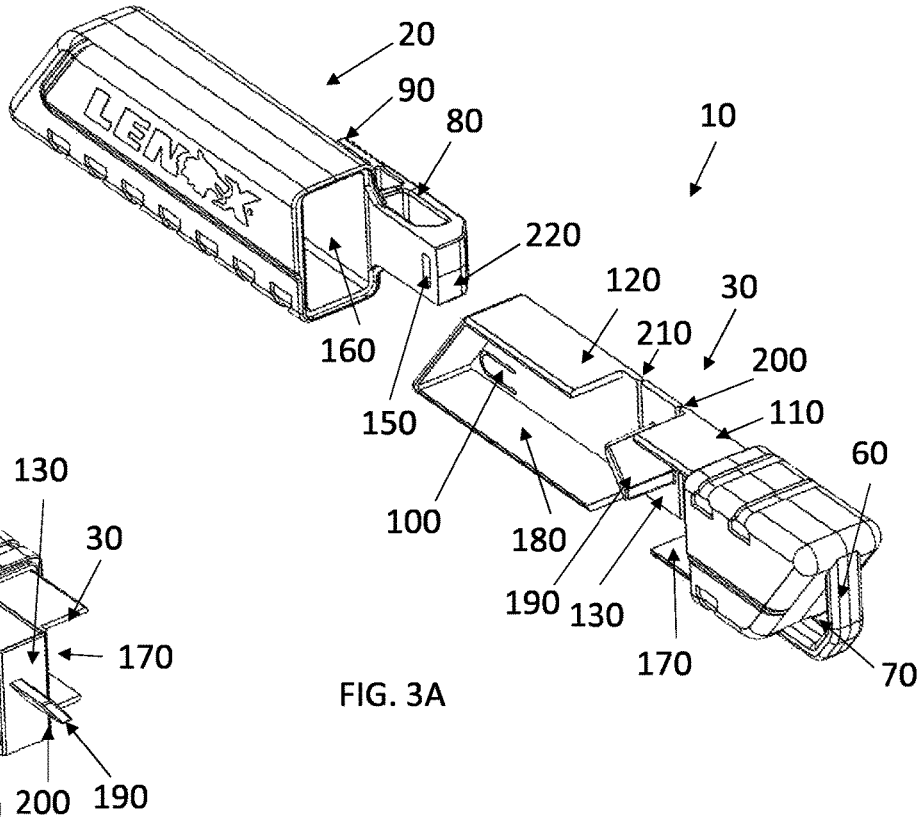
FIG. 3A is an exploded front perspective view of the embodiment of the blade dispenser, with the lid portion removed from the body portion.

FIG. 3A shows another perspective of the blade dispenser 10 in the exploded view. From this perspective, a retaining feature 150 is shown on an opposite face of the clip 80. It may be appreciated that the engagement feature 140 may normally engage the retaining feature 150 when the lid portion 30 is fully inserted into the body portion 20, and may deter (but not prevent) extension of the lid portion 30 from the body portion 20, until a user pulls with sufficient force to overcome the engagement (e.g., by temporarily deforming one or more of the engagement feature 140, the retaining feature 150, or the clip 80).

In the view of FIG. 3A, a channel 160 of the body portion 20 is seen, into which the second lid portion 120 is received into. As understood from the illustrated embodiment, in an embodiment the channel 160 includes the slide track 40 therein (e.g., extending from the channel 160 to an outer surface of the body portion 20 in some embodiments). As further shown, in an embodiment the lid portion 30 includes a first blade chamber 170 in the first lid portion 110, and a second blade chamber 180 in the second lid portion 120, separated by the hinge portion 130. In an embodiment, each of the first blade chamber 170 and the second blade chamber 180 may be generally trapezoidal in shape, and either or both may be shaped as an isosceles trapezoid, such as is commonly used for utility knife blades. In an embodiment, the hinge portion 130 includes a separator wall 190 which may act as a divider and may define a desired shape to separate the first blade chamber 170 from the second blade chamber 180. As shown, in an embodiment the separator wall 190 may define an isosceles trapezoid shape for one or more of the first and second blade chambers 170, 180. While in the illustrated embodiment the blade chambers 170, 180 and the separator wall 190 therebetween are shaped so that isosceles trapezoid utility knife blades in the first blade chamber 170 face opposite similarly configured blades in the second blade chamber 180 (e.g., with sharpened edges facing in opposite directions for conventional blades), in other embodiments the first and second blade chambers 170, 180 may be configured to hold differing shapes or configurations of blades (e.g., each of the chambers 170, 180 being configured to hold one of isosceles trapezoid utility knife blades, snap knife blades, hacksaw blades, reciprocating saw blades, jig saw blades, or so on, which may be the same or different as compared to the other of the chambers 170, 180).

It may be appreciated that where the blade chambers 170, 180 are both configured to retain isosceles trapezoid shapes of conventional utility blades, by orienting the chambers so that the sharpened edges of blades in the first blade chamber 170 are positioned opposite the sharpened edges of blades in the second blade chamber 180, the blades may be positioned closer to one another in a space saving configuration such that both blade chambers 170 and 180 in the closed or extended configurations for the blade dispenser 10 extend across the hinge portion 30. As shown, the separator wall 190 in such embodiments may be angled relative to the extension of the lid portion 30 and may define a common contour for the leg of the isosceles trapezoid shape of a conventional utility knife blade (and as such may generally match the base angle of the isosceles trapezoid shape relative to the extension where the sharpened edges of the blades would be positioned in the blade chambers 170 and 180). Accordingly, in some embodiments from a front view the combined shape of the body portion 20 and the lid portion 30 when in the closed configuration for the blade dispenser 10 may approximate a parallelogram (e.g., as shown in FIG. 5A discussed below, excluding the loop 60).

Figure 3B:
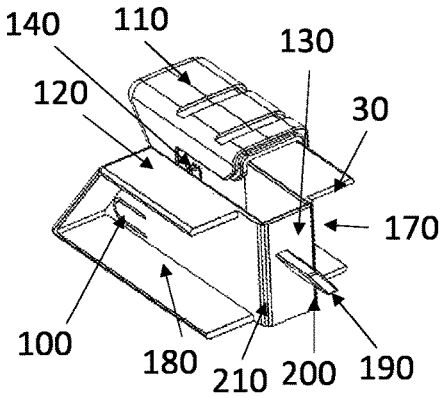
FIG. 3B depicts an isolated view of the lid portion from the same perspective as FIG. 3A, however showing the lid potion in a folded configuration.

As discussed above, the hinge portion 130 may be configured to permit folding of the first lid portion 110 relative to the second lid portion 120. Such folding may be appreciated in FIG. 3B, where the lid portion 30 is shown in isolation in a folded configuration. As shown, a first seam 200 extends between the hinge portion 130 and the first lid portion 110 and a second seam 210 extends between the hinge portion 130 and the second lid portion 120. It may be appreciated that the first seam 200 and the second seam 210 may permit the hinge portion 130 and any separator wall 190 carried thereon to be moved away from the first blade chamber 170 and the second blade chamber 180, thus exposing an opening to the first blade chamber 170 and the second blade chamber 180 to permit removal of blades therein, as shown in greater detail below. In some embodiments where the hinge portion 130 is integral to the first lid portion 110 and the second lid portion 120, the first seam 200 and second seam 210 may be regions of reduced material permitting flexibility or folding therebetween. In other embodiments, either or both of the first seam 200 and the second seam 210 may be defined by hinge connectors, flexible material coupling, or other similar configurations.

Figure 4A:
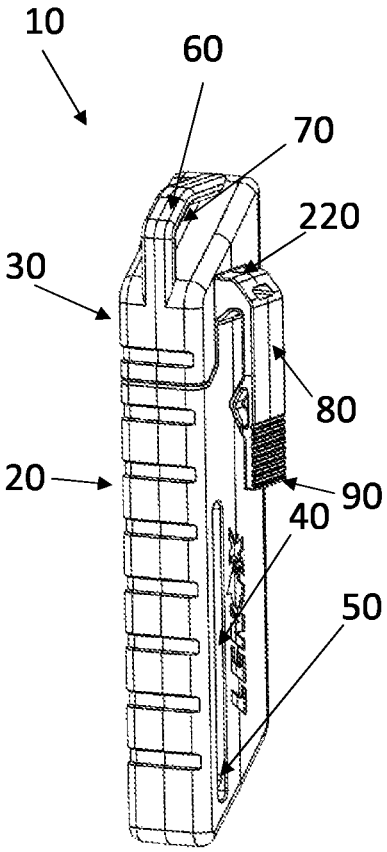
FIG. 4A is a rear perspective view of the embodiment of the blade dispenser in the closed position.
Figure 4B:
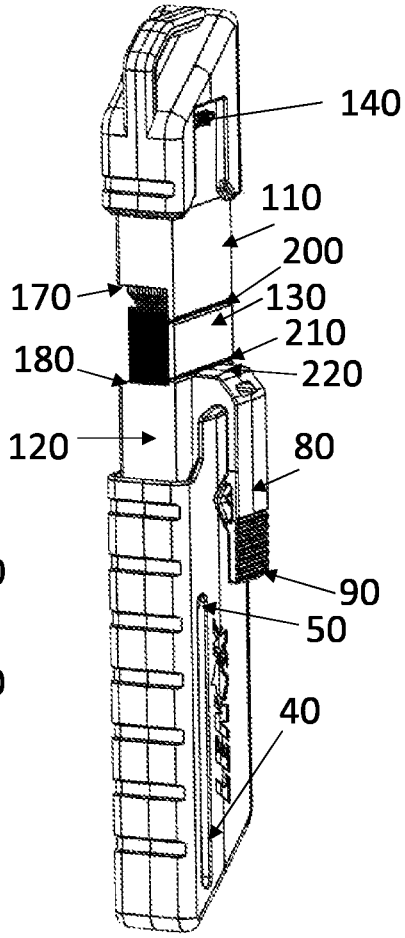
FIG. 4B is a rear perspective view of the embodiment of the blade dispenser in an extended position.
Figure 4C:
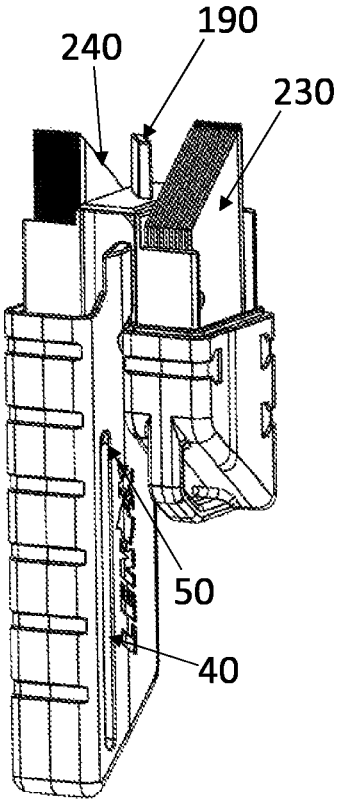
FIG. 4C is rear perspective view of the embodiment of the blade dispenser in an open position.
Figure 5A:
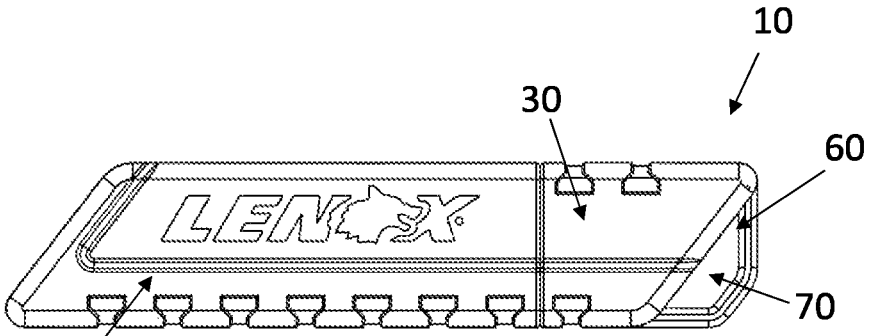
FIG. 5A is a front view of the embodiment of the blade dispenser in the closed position.
Figure 5B:
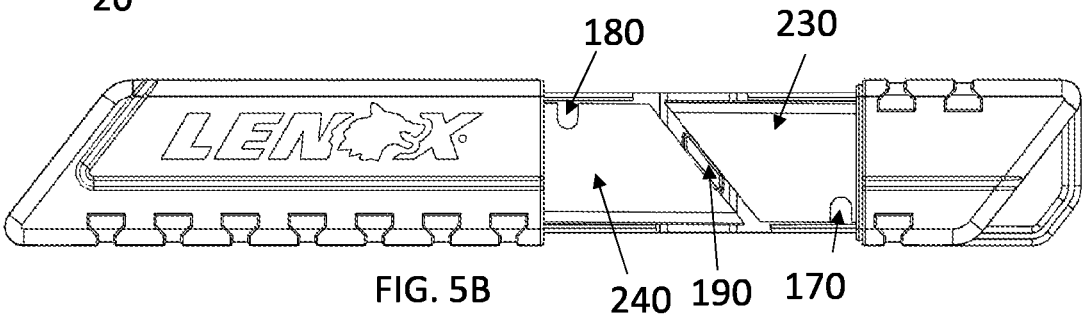
FIG. 5B is a front view of the embodiment of the blade dispenser in the extended position.
Figure 5C:
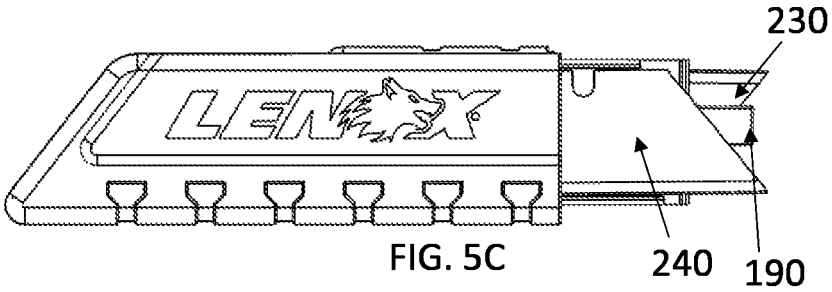
FIG. 5C is front view of the embodiment of the blade dispenser in the open position.
Figure 6A:
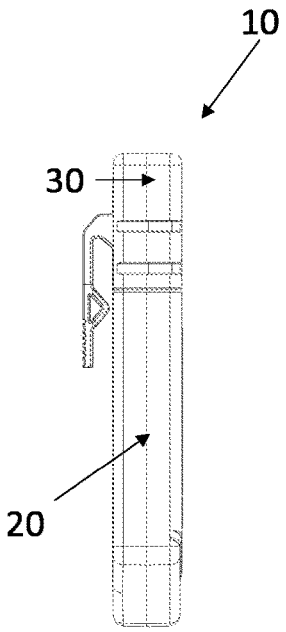
FIG. 6A is a side view of the embodiment of the blade dispenser in the closed position.
Figure 6B:
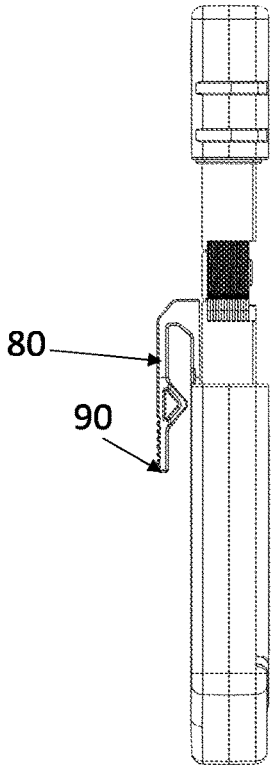
FIG. 6B is a side view of the embodiment of the blade dispenser in the extended position.
Figure 6C:
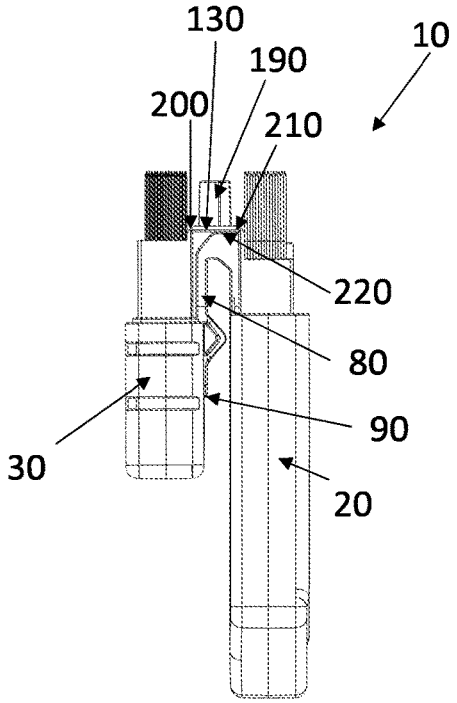
FIG. 6C is side view of the embodiment of the blade dispenser in the open position.

FIGS. 4A-C, 5A-C, and 6A-C illustrate different views of the blade dispenser 10 in each of the closed, extended, and open configurations. In particular, FIG. 4A, FIG. 5A, and FIG. 6A illustrate the blade dispenser 10 in a closed configuration in each of a rear perspective view, front view, and side view. FIG. 4B, FIG. 5B, and FIG. 6B illustrate the blade dispenser 10 in an extended configuration in each of the rear perspective view, front view, and side view. FIG. 4C, FIG. 5C, and FIG. 6C illustrate the blade dispenser 10 in an open configuration in each of the rear perspective view, front view, and side view.

As seen by comparing these views, by sliding the lid portion 30 relative to the body portion 20, the blade dispenser 10 moves from the closed configuration of FIG. 4A, FIG. 5A, and FIG. 6A to the extended configuration of FIG. 4B, FIG. 5B, and FIG. 6B. As seen between FIG. 4A and FIG. 4B, the extended configuration may be defined by the slide stop 50 moving along the slide track 40 until it reaches a terminal end thereof. As shown, in an embodiment the slide stop 50 reaching the terminal end of the slide track 40 may be configured to align with the second seam 210 aligning with an upper surface 220 of the body portion 20. In some embodiments, such as that illustrated, the upper surface 220 is generally defined by the clip 80. As such, in some embodiments, by moving the blade dispenser 10 into the extended position of In the extended configuration, the hinge portion 130 may be folded at the second seam 210 over the upper surface 220 of the body portion 20, and then may be folded at the first seam 200 over the clip 80 to move the blade dispenser 10 into the open position shown in FIG. 4C, FIG. 5C, and FIG. 6C. Accordingly, in some embodiments, the extension of the hinge portion 130 between the first lid portion 110 and the second lid portion 120 may be sized to match a dimension of protrusion of the clip 80 away from the channel 160.

As indicated above, in some embodiments the engagement feature 140 may be configured to engage with retaining feature 90 when the blade dispenser 10 is moved into the open position. As such, the retaining feature 90, which in some embodiments may be a clip that hooks onto a terminal end of the clip 80 to tend to hold the blade dispenser 10 in the open position until some force is applied by a user to return the lid portion 30 into the extended position such that it may be slid back into the body portion 20 to move the blade dispenser 10 back into the closed position. As shown, in an embodiment the engagement feature 140 may include a recessed shape in the first lid portion 110 configured to match a contour of the clip 80 (e.g., defining the retaining feature 90), so that when the first lid portion 110 is folded over the clip 80, it receives the clip 80 therein, and in some embodiments may snap or snugly hold thereto. In some embodiments, either or both of the retaining feature 90 and the engagement feature 140 may comprise a magnet, which may be embedded into or form a portion of the lid portion 30 or the clip 80. In some embodiments, where one of the retaining feature 90 and the engagement feature 140 comprise a magnet, the other of the retaining feature 90 and the engagement feature 140 may comprise a magnetically attractive metal. Accordingly, in some embodiments either or both of the engagement feature 140 or the retaining feature 90 may be configured to hold the lid portion 30 in either the closed configuration relative to the body portion 20 (deterring movement into the extended position) or in the open configuration relative to the body portion 20 (deterring movement from a saddle configuration of the lid portion 30 in the open configuration back into the extended position).

As shown in FIG. 4C, FIG. 5C, and FIG. 6C, upon movement of the blade dispenser 10 into the open position, blades 230 located in the first blade chamber 170 of the first lid portion 110 and blades 240 located in the second blade chamber 180 of the second lid portion 120 may protrude from the blade chambers 170 and 180 so that the blades may be slid out of the blade dispenser 10. Accordingly, it may be understood that the dual hinge configuration of the hinge portion 130 with the seam 200 and seam 210 may provide for a saddle display configuration for the blades 230 and the blades 240. Similarly, it may be appreciated that in some embodiments sizing of the blade dispenser 10 may allow a thumb of a user holding the blade dispenser 10 in the open configuration to engage blades 230 located in the first blade chamber 170 of the first lid portion 110 and blades 240 located in the second blade chamber 180 of the second lid portion 120 simultaneously while holding the blade dispenser 10.

In various embodiments, one or more of the body portion 20 and the lid portion 30 may be opaque, transparent, or translucent. For example, in an embodiment, the lid portion 30 may be opaque, while the body portion 20 may be transparent or translucent so that a user may see what is stored within. In some embodiments, parts of the body portion 20 or the lid portion 30 may be transparent, while other parts of the body portion 20 or the lid portion 30 may be opaque.

It may be appreciated that conventional utility knife blades such as those illustrated as blades 230 and blades 240 include a planar body with a sharpened edge, and may include one or more mounting features that are used to retain the blade in a utility knife. Such blades may commonly be of an isosceles trapezoid configuration, with the mounting feature opposite the sharpened edge. Other utility knife blades may include mounting feature(s) located to the interior of the planar body, may include a sharpened hook configuration, rounded points, or have other conventional configurations that generally approximate an isosceles trapezoid in expanse. It may be appreciated that the teachings herein may also be applicable to so called "snap knife" utility knife blades, which typically are elongated to include a plurality of connected blade segments with a mounting feature at one side, so that the blade may be extended from the knife, and blade segments may be broken off to expose previously unused sharpened points and portions of the blade.

While in some embodiments the blade dispenser 10 may be formed of plastic, other materials may be utilized instead or in addition in the construction of such blade dispensers 10. For example, as noted above, the seams 200 and or 210 may be formed as flexible plastic material integral to the first lid portion 110, second lid portion 120 and hinge portion 130 (e.g., as living hinges), in other embodiments the hinge portion 130 may be formed of a separate flexible material such as a fabric or weave, securing the first lid portion 110 to the second lid portion 120. In some embodiments, the entirety of the body portion 20 and the lid portion 30 may each be formed as single pieces of molded plastic (e.g., injection molded) while in other embodiments the body portion 20 and the lid portion 30 may each be formed as an assembly of different components that may be coupled together by adhesives, mechanical fasteners, interlocking or snap fitting components, or so on.

Figure 7A:
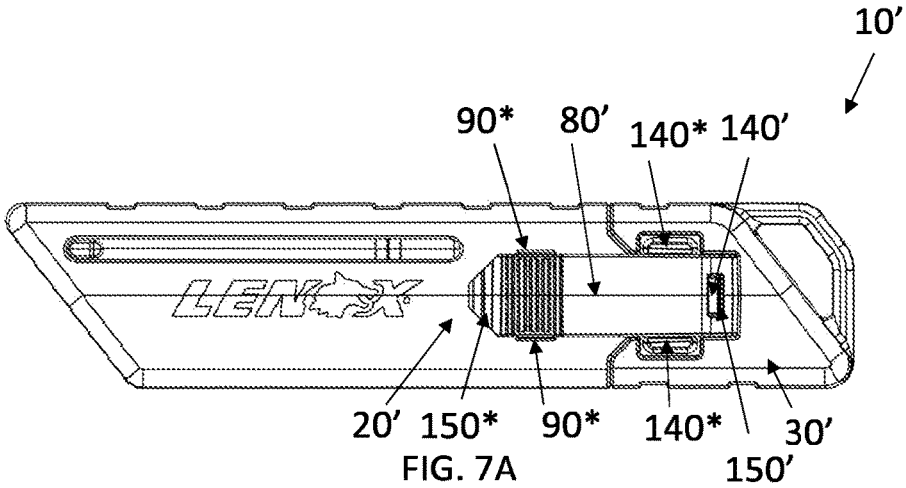
FIG. 7A is a rear view of another embodiment of a blade dispenser of the present disclosure in a closed position, having a body portion and a lid portion.

As discussed above, in some embodiments the engagement feature 140 may normally engage the retaining feature 150 when the lid portion 30 is fully inserted into the body portion 20, and may deter (but not prevent) extension of the lid portion 30 from the body portion 20, until a user pulls with sufficient force to overcome the engagement (e.g., by temporarily deforming one or more of the engagement feature 140, the retaining feature 150, or the clip 80). Similarly, the retaining feature 90 is noted as in some embodiments selectively engaging with engagement feature 140 when the blade dispenser 10 is moved into the open position, and may tend to hold the blade dispenser 10 in the open position until some force is applied by a user to return the lid portion 30 into the extended position such that it may be slid back into the body portion 20 to move the blade dispenser 10 back into the closed position. Another embodiment of such engagement and retaining features may be seen more clearly with reference to FIG. 7A, FIG. 7B, and FIG. 8A, discussed below.

Figure 7B:
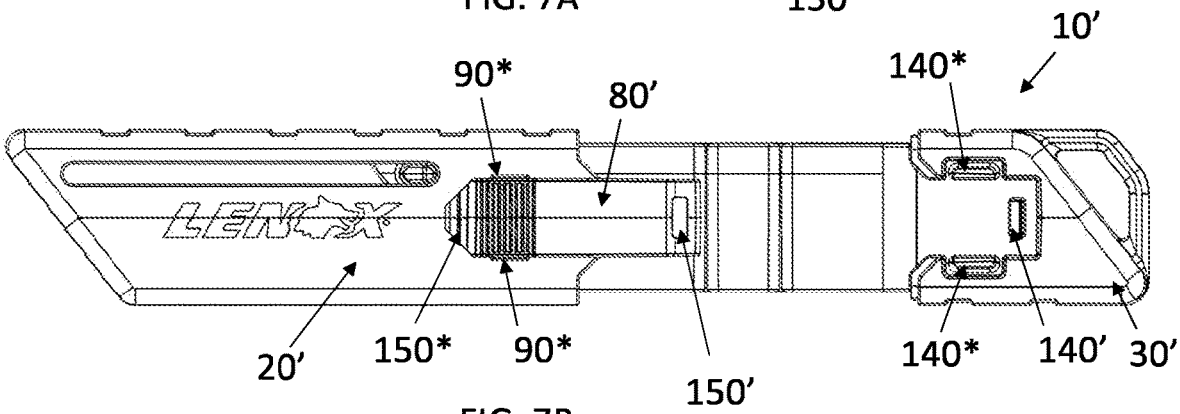
FIG. 7B is a rear view of the embodiment of the blade dispenser of FIG. 7A in the extended position.
Figure 8A:
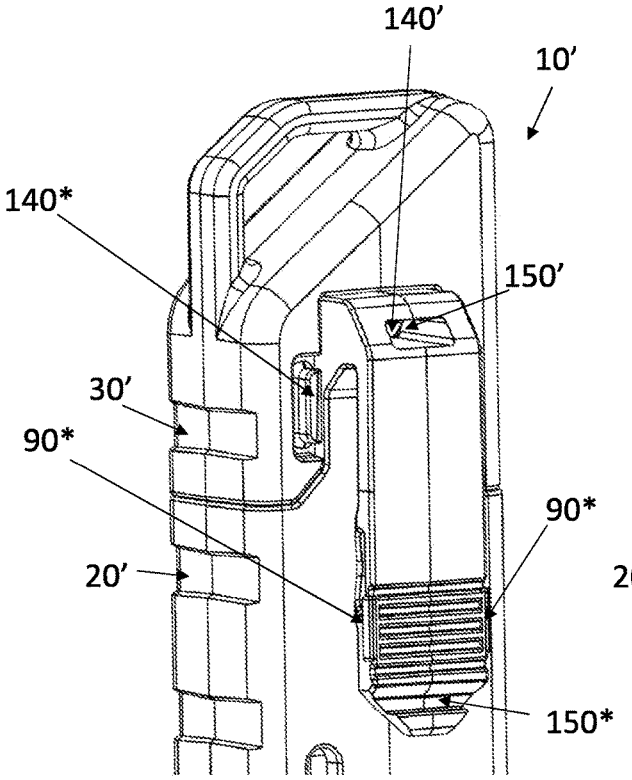
FIG. 8A is an enlarged rear perspective view of the embodiment of the blade dispenser of FIG. 7A in the closed position.

As shown therein, in some embodiments a blade dispenser 10' may be similar or identical to the blade dispenser 10 discussed above except for as otherwise indicated. Like components are numbered similarly save for the addition of an apostrophe ('), or as modified indicated by addition of an asterisk (*). Specifically, the blade dispenser 10' includes a body portion 20' and a lid portion 30'. The lid portion 30' includes an engagement feature 140' and a clip 80' includes a retaining feature 150', such that when the blade dispenser 10' is in the closed position shown in FIG. 7A and FIG. 8A, the engagement feature 140' engages the retaining feature 150' to deter (but not prevent) extension of the lid portion 30' from the body portion 20'. By overcoming the retention thereof, the lid portion 30' may be extended from the body portion 20', as shown in FIG. 7B.

Figure 8B:
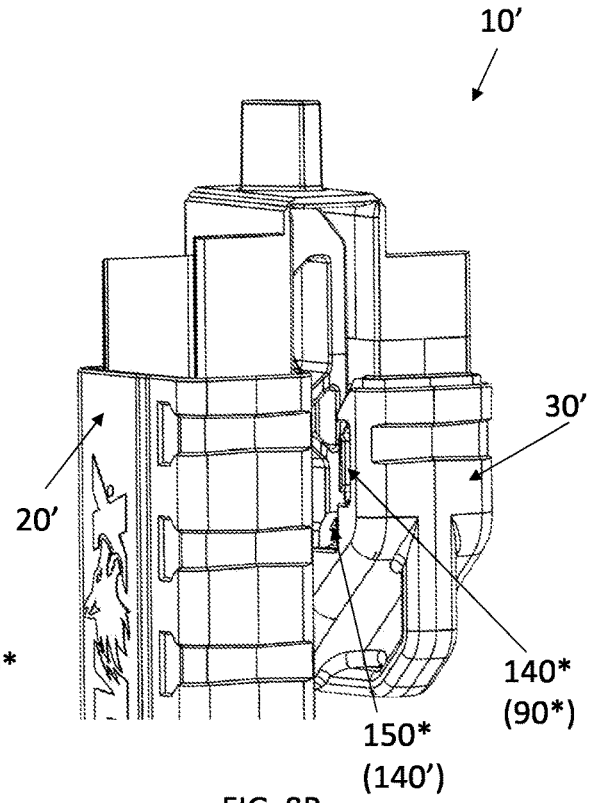
FIG. 8B is an enlarged front perspective view of the embodiment of the blade dispenser of FIG. 7A in the open position.

Further shown is that in some embodiments the clip 80' may include side retaining features 90*. Similarly, in some embodiments the clip 80' may include a retaining feature 150*. In the illustrated embodiments, the lid portion 30' includes side engagement features 140*. As shown in FIG. 8B, when the blade dispenser 10' is opened and folded into the open position, the side engagement features 140* may engage (e.g., snap into or be snapped into by) the side retaining features 90* on the clip 80', which may hold the lid portion 30' in the folded position over the clip 80', and deter (but not prevent) moving the blade dispenser 10' from the open position of FIG. 8B back to the extended position of FIG. 7B. Similarly, in some embodiments engagement between the engagement feature 140' on the lid portion 30' and the retaining feature 150* on the clip 80' may also assist or act to deter releasing the lid portion 30' from its folded configuration when the blade dispenser 10' is in the open position. The overlapping configuration of the side engagement features 140* and the side retaining features 90* are indicated by common arrow in FIG. 8B. Similarly, the common arrow indicates an overlapping configuration of the retaining feature 150* and the engagement feature 140*.

It may be appreciated that the functionality of engagement feature 140' may be achieved by side engagement features 140* engaging with other retaining features 150' on the clip 80' in other embodiments. Similarly, the functionality of any described retaining feature and any described engagement feature may be flipped in various embodiments, with engagement features located on the clip 80' and retaining features located on the lid portion 30' in some embodiments, for instance. Overcoming such retention may be accomplished by temporarily deforming one or more of the engagement features, the retaining features, or the clip or other portions of the lid portion or the blade dispenser, such as through resiliency of the material from which the components are formed, in various embodiments.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments have been provided so that this disclosure will be thorough, and to fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Terms of degree such as "generally," "substantially," "approximately," and "about" may be used herein when describing the relative positions, sizes, dimensions, or values of various elements, components, regions, layers and/or sections. These terms mean that such relative positions, sizes, dimensions, or values are within the defined range or comparison (e.g., equal, or close to equal) with sufficient precision as would be understood by one of ordinary skill in the art in the context of the various elements, components, regions, layers and/or sections being described.

Numerous modifications may be made to the exemplary implementations described above. These and other implementations are within the scope of the following claims.

What is claimed is:

1. A blade dispenser comprising:

a body portion; and a lid portion slidable along and laterally away from the body portion to move the blade dispenser between a closed configuration and an extended configuration;

wherein the lid portion comprises a first lid portion having a first blade chamber and a second lid portion having a second blade chamber;

wherein the first lid portion and the second lid portion are coupled by a hinge portion configured to permit the first lid portion to pivot relative to the second lid portion to move the blade dispenser from the extended configuration to an open configuration;

wherein in the open configuration blades may be removed from or inserted into both the first blade chamber and the second blade chamber.

2. The blade dispenser of claim 1, wherein the hinge portion comprises a first seam coupling the hinge portion to the first lid portion and a second seam coupling the hinge portion to the second lid portion.

3. The blade dispenser of claim 2, wherein one or more of the first seam and the second seam comprises a living hinge.

4. The blade dispenser of claim 1, wherein the hinge portion comprises a separator wall.

5. The blade dispenser of claim 4, wherein the separator wall and either of the first blade chamber and the second blade chamber define an isosceles trapezoid shape.

6. The blade dispenser of claim 4, wherein the separator wall and each of the first blade chamber and the second blade chamber define a pair of isosceles trapezoid shapes.

7. The blade dispenser of claim 1, wherein in the closed configuration the body portion and the lid portion generally form a parallelogram.

8. The blade dispenser of claim 7, further comprising a loop protruding from the blade dispenser.

9. The blade dispenser of claim 1, wherein in the closed configuration the first blade chamber and the second blade chamber together generally form a parallelogram.

10. The blade dispenser of claim 1, further comprising a clip.

11. The blade dispenser of claim 10, wherein in the open configuration the hinge portion and the first lid portion fold over the clip.

12. The blade dispenser of claim 10, wherein the body portion comprises a retaining feature configured to engage with an engagement feature formed on the first lid portion to selectively hold the blade dispenser in the closed configuration.

13. The blade dispenser of claim 1, wherein the wherein the first lid portion, the second lid portion, and the hinge portion are integrally formed together.

14. The blade dispenser of claim 1, wherein one or more of the first blade chamber and the second blade chamber are shaped to hold stacks of utility knife blades.

15. A blade dispenser comprising:

a body portion; and a lid portion slidable relative to the body portion to move the blade dispenser between a closed configuration and an extended configuration;

wherein the lid portion comprises a first lid portion having a first blade chamber and a second lid portion having a second blade chamber;

wherein the first lid portion and the second lid portion are coupled by a hinge portion configured to permit the first lid portion to pivot relative to the second lid portion to move the blade dispenser from the extended configuration to an open configuration;

wherein in the open configuration blades may be removed from or inserted into both the first blade chamber and the second blade chamber;

further comprising a clip;

wherein the clip comprises a retaining feature configured to engage with an engagement feature formed on the first lid portion to selectively hold the blade dispenser in the open configuration.

16. The blade dispenser of claim 15, wherein one or more of engagement feature and the retaining feature comprise a magnetically attractive material.

17. The blade dispenser of claim 15, wherein the first lid portion comprises a recessed portion configured to receive the clip therein.

18. A blade dispenser comprising:

a body portion; and a lid portion slidable relative to the body portion to move the blade dispenser between a closed configuration and an extended configuration;

wherein the lid portion comprises a first lid portion having a first blade chamber and a second lid portion having a second blade chamber;

wherein the first lid portion and the second lid portion are coupled by a hinge portion configured to permit the first lid portion to pivot relative to the second lid portion to move the blade dispenser from the extended configuration to an open configuration;

wherein in the open configuration blades may be removed from or inserted into both the first blade chamber and the second blade chamber;

wherein the body portion comprises a slide track and the lid portion comprises a slide stop configured to slide along the slide track to limit movement of the lid portion relative to the body portion when moving the blade dispenser into the extended configuration.

19. The blade dispenser of claim 18, wherein the slide stop and slide track are positioned such that in the extended configuration the hinge portion aligns with an upper surface of the body portion, such that the hinge portion folds over the upper surface when the first lid portion pivots relative to the second lid portion to move the blade dispenser from the extended configuration to the open configuration.

* * * * *